US005551226A

United States Patent [19]

Keir et al.

[11] Patent Number: 5,551,226

[45] Date of Patent: Sep. 3, 1996

[54] DISK FOR OPEN END SPINNING

[75] Inventors: Richard M. Keir, 4 Forest La., Greenville, S.C. 29605; William L. Brigham, Jr., 132 Winfield Rd., Greenville, S.C. 29607; Barry S. Ballew, Travelers Rest; Cam W. Abshire, Greenville, both of S.C.

[73] Assignees: Richard M. Keir; William L. Brigham, Jr., both of Greenville, S.C.

[21] Appl. No.: 522,975

[22] Filed: Sep. 1, 1995

[51] Int. Cl.[6] ..... D01H 4/00; D01H 13/00

[52] U.S. Cl. ..... 57/406; 57/104; 384/120; 384/563; 384/566; 384/588

[58] Field of Search ..... 474/188, 189; 384/120, 549, 557, 563, 565, 566, 587, 588; 57/103, 104, 105, 406

[56] References Cited

U.S. PATENT DOCUMENTS

| | | | |
|---|---|---|---|
| 3,779,620 | 12/1973 | Stahlecker | 308/203 |
| 3,805,506 | 4/1974 | Stahlecker | 57/78 |
| 4,020,710 | 5/1977 | Gassner et al. | 57/103 |
| 4,667,464 | 5/1987 | Stahlecker et al. | 57/464 |
| 4,676,673 | 6/1987 | Stahlecker et al. | 384/549 |
| 5,178,473 | 1/1993 | Oexler et al. | 384/549 |
| 5,423,616 | 6/1995 | Gotz | 57/406 |

*Primary Examiner*—William Stryjewski
*Attorney, Agent, or Firm*—Henry S. Jaudon; Cort Flint

[57] ABSTRACT

A disk for use in a bearing assembly of an open end spinning machine having four disks arranged in two pairs and which operate at up to 15,000 RPM's while the rotor shaft turns at up to 125,000 RPM's. The disk pairs are arranged to form a wedge shaped gap supporting the shaft of a spinning rotor for rotation. Each disk comprises a metallic hub which mounts a synthetic ring. The synthetic ring has a spinning rotor contact surface comprising a shoulder arranged atop a helically disposed rib which extends around and across the contact surface. The shoulder imparts an axial thrust against the spinning rotor during operation of the spinning machine.

21 Claims, 3 Drawing Sheets

Fig. 2-A.
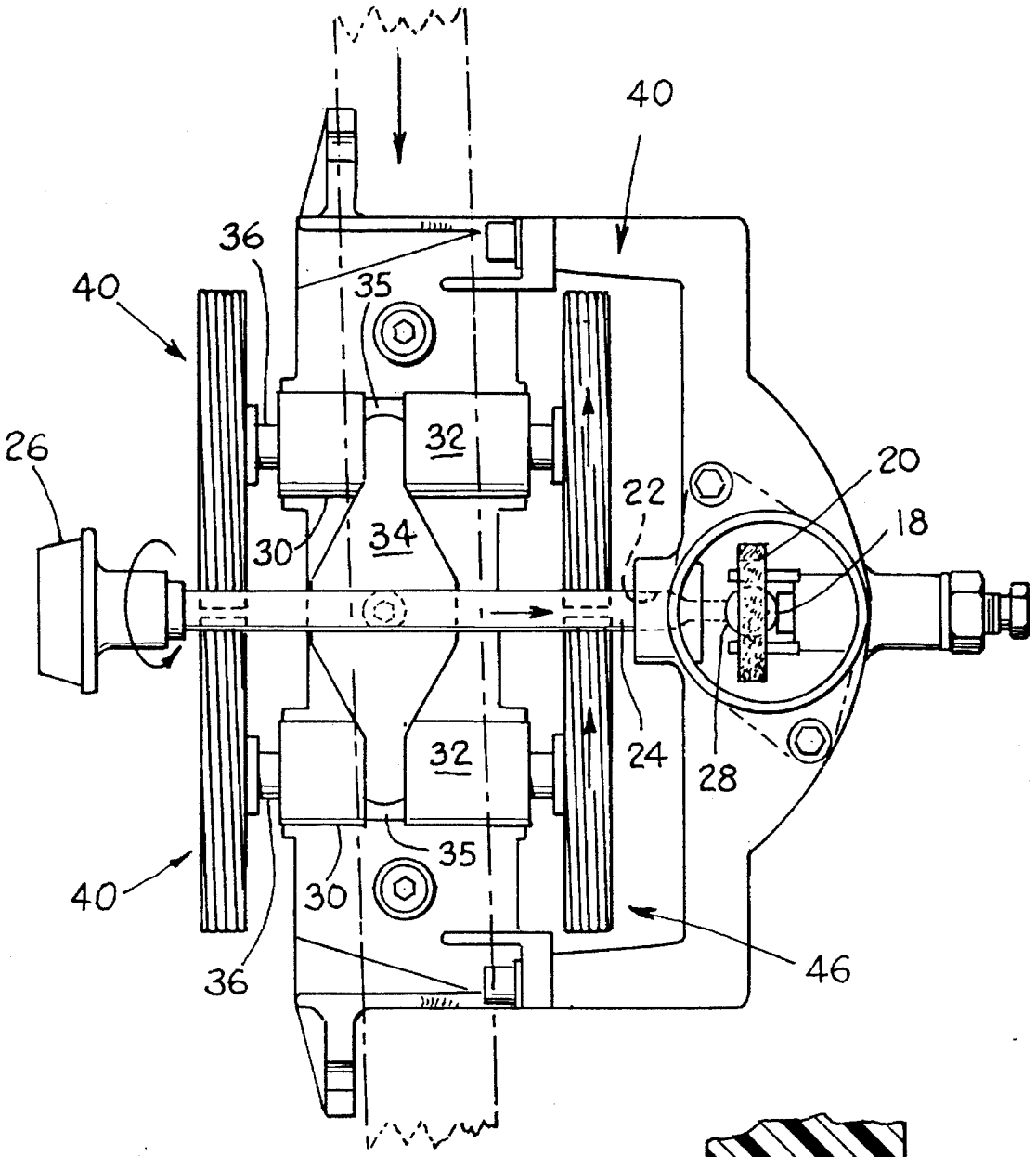
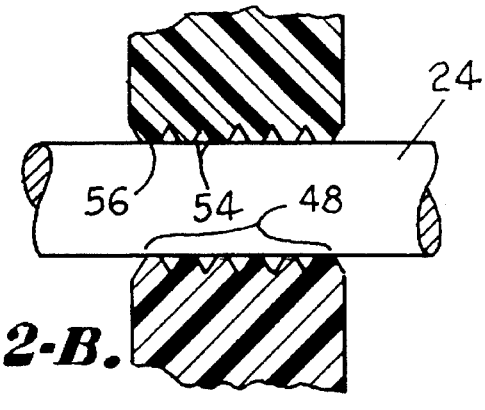
Fig. 2-B.

DISK FOR OPEN END SPINNING

BACKGROUND OF THE INVENTION invention relates to a supporting disk bearing for use in an open end spinning machine. The supporting disks are used in pairs and are disposed to form a wedge shaped gap which supports a spinning rotor. The arrangement is such that the supporting disks function to urge the end of the spinning rotor against the thrust bearing evenly and continuously during operation of the spinning machine.

It is known to mount the spinning rotor of open end spinning frames in a wedge shaped gap formed by supporting disk and to press the rotor against the disk with a transversely disposed driving belt or pressure roller. It is also known to provide the supporting disk with elastic rings which are provided with a heat reducing groove or grooves to provide for quiet running at high speeds. It is further known to maintain the rotor seated by providing an axial thrust toward the thrust bearing by adjusting the axial alignment of the disk bearings relative to the rotor shaft and to the driving member. These arrangements including the force with which the drive member is pressed against the spinning rotor have resulted in rapid wear and de-generation of the elastic ring of the supporting disk as well as the driving member. As a result, frequent down time occurs during the replacement of these units.

U.S. Pat. Nos. 3,805,506 and 3,779,620 to Stahlecker; U.S. Pat. No. 4,676,673 to Stahlecker et al; and U.S. Pat. No. 5,178,473 to Oexler et al each show various of the above described arrangements currently being practiced.

In particular, U.S. Pat. Nos. 4,676,673 and 5,178,473 disclose forming a groove in the elastic ring which allows the ring to better dissipate the heat which builds up during operation and thereby slow the destructive effects of heat build-up within the ring. These patents do not discuss reducing slipping by increasing traction between the rotor shaft and the elastic ring.

U.S. Pat. Nos 3,779,620 and 3,805,506 teach inclining the shafts supporting the supporting disk so that the supporting disks produce an axial thrust against the spinning rotor shaft during operation. A major drawback of this arrangement is insuring that equal thrust between the spinning heads is exerted against the spinning rotors. Another is excessive wear due to mis-alignment and increased slippage.

The instant invention has as one of its objects the provision of supporting disk bearings for use in open end spinning machines which operate with reduced slippage and thereby possess extended wear qualities.

Another object of the invention is the provision of a supporting disk having a running surface composed of a rib arranged in a helical spiral about the outer surface of the disk to form a running surface comprised of a plurality of spaced shoulders.

Another object of the invention is the provision of a supporting disk having a running surface configured to axially urge the spinning rotor into continuous engagement with the thrust bearing.

Another object of the invention is the provision of open end spinning heads in which an axial thrust of equal force is applied against each spinning rotor.

Another object of the invention is the provision of a supporting disk which allows less slippage between the spinning rotor and the supporting disk due to increased adhesion.

Another object of the invention is the provision of a supporting disk for use with open end spinning machines capable of prolonged life while operating at up to 15,000 RPM's.

Another object of the invention is the provision of a supporting disk having an extended operating life.

SUMMARY OF THE INVENTION

The instant invention is directed to a supporting disk bearing for use in an open spinning machine. An open end spinning machine includes a frame, two pair of supporting disks mounted in the frame to form a wedge shaped gap, a spinning rotor having an elongated shaft which is mounted in the gap in rotational engagement with the disk, and a thrust bearing carried by the frame and arranged to engage an end of the rotationally mounted rotor shaft. A drive is carried by the frame and is arranged transversely of the rotor shaft. The drive presses the rotor shaft against a running surface provided on each of the supporting disks.

The supporting disks comprise a hub carrying an elastic ring, the peripheral surface of which comprises the running surface. The running surface comprises a helically formed rib presenting a plurality of slanted shoulders spiralled toward the thrust bearing. The slanted shoulders act to better adhere with the surface of the rotor shaft to uniformly and constantly urge it against the thrust bearing during operation of the spinning machine. This action prevents axial movement of the rotor shaft which maintains the shaft in smooth running engagement with the thrust bearing. The increased adhesion between the supporting disk and the rotor shaft reduces slippage which increases the life of the supporting disk and improves the performance of the spinning machines by providing more uniform spinning.

The helical rib begins adjacent a first edge of the ring and passes around the running surface a plurality of times before terminating adjacent the opposite edge of the ring. The shoulders are spaced by a cavity which is formed to have a depth of between 0.005" and 0.08" and a width at least adjacent the running surface of between 0.01" and 0.03". The cavity may be V shaped or U shaped.

The helical rib is arranged so that the shoulder appears across the width of said running surface between two and eight times. The shoulder is formed with a width of between 0.02" and 0.04". The rib is preferably continuous and uninterrupted along its entire length.

The elastic ring is preferably formed of polyurethane or polyester copolymers and the running surface is formed to have a width of between 0.3" and 0.31".

The invention includes the method increasing the operational life of a supporting disk bearing in an open end spinning machine by providing the supporting disk with an elastic ring and forming a running surface over the periphery of the ring as helical rib presenting a plurality of spindle contacting shoulders spaced by a plurality of cavities. The rib is helically arranged about the periphery of the ring in a direction toward a thrust bearing.

In operation the plurality of helically arranged shoulders act to prolong the life of the supporting disk by engaging firmly with the spindle to prevent slippage and also to prolong the life of the spinning rotor by constantly urging the rotor axially against the thrust bearing preventing axial motion. The method includes providing a single continuous heat reducing channel which appears a multiple of times across the width of said running surface. The continuous channel defines at least four shoulders across said running surface of the supporting disk with each shoulder having a width of at least 0.02".

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2A is a top view of the spinning head shown in FIG. 1;

FIG. 2B is a detailed sectional view showing the outer surface of the spinning rotor engaging with the running surface.

DESCRIPTION OF A PREFERRED EMBODIMENT

Figure 1:
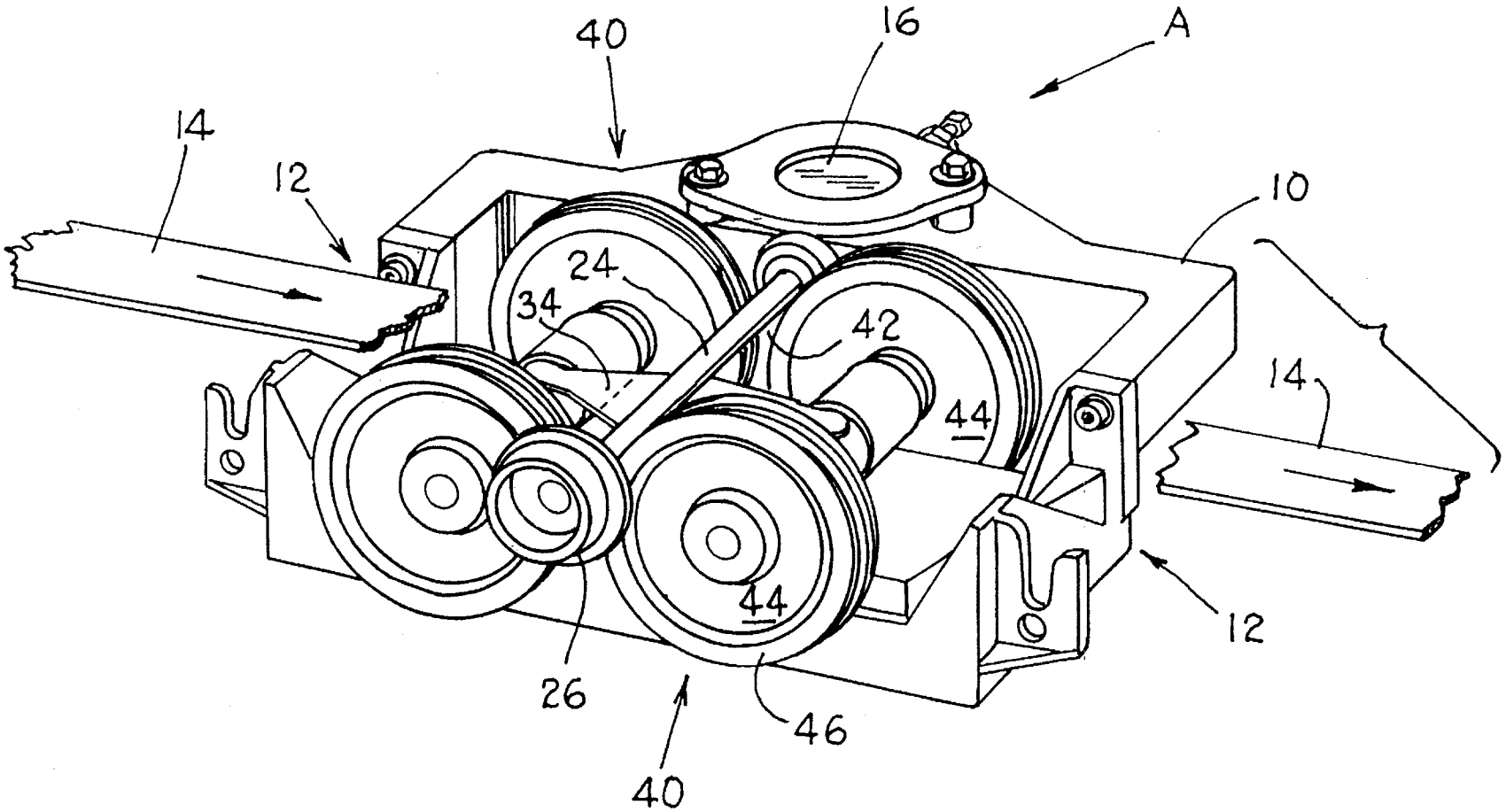
FIG. 1 is a perspective view of a spinning head of an open end spinning machine.

Referring now to the drawings, FIGS. 1, 2A, and 2B show partially an open end spinning machine A. The elements shown are housing 10 having opposed drive openings 12 which receive the drive belt 14. Frame 10 includes a housing 16 which carries thrust bearing 18. Lubricating wick 20 maintains thrust bearing 18 lubricated. Housing 16 includes an opening 22 through which passes rotor shaft 24 carrying rotor 26. End 28 of rotor shaft 24 engages with thrust bearing 18 when the spinning machine is in operation. The rotor 26 is carried by the opposite end of rotor shaft 24.

Frame 10 includes a pair of bearing supports 30 which each receive a bearing 32. Supports 30 comprise a half circle which freely mount bearings 32. A finger 34 passes over bearings 32 and is received in frame 10 by any suitable device such as a nut. Finger 34, which fits into a slot 35 formed in bearings 32 acts to maintain the bearings positioned in supports 30. Slot 35 and finger 34 may be arranged in an off center position thereby limiting bearings 32 to a single mounting position within housing 10.

Bearing 32 mounts an axle 36 which extends outwardly of the opposing ends of the bearing. Supporting disk 40, which are arranged in pairs, are secured to the opposing ends of axles 36.

Supports 30 mount bearings 32 in housing 10 to position the pairs of supporting disk 40 in horizontally spaced relationship so that they form a gap 42 therebetween. Rotor shaft 24 is placed in gap 42 to be supported by supporting disk 40. End 28 of rotor shaft 24 is positioned through opening 22 in contact with thrust bearing 18. In operation, any of several known devices, move drive 14 into contact with the peripheral surface of rotor shaft 24 to rotationally drive rotor 26. Due to the extremely high RPM's the rotor shaft 24 and disk 40 are driven, i.e. up to 125,000 and 15,000 respectively, it is imperative that the shaft be maintained in contact with thrust bearing 18 during start up and during operation.

Supporting disk 40 comprises a hub 44 which is usually machined or cast aluminum. An elastic ring 46 is mounted about and secured with hub 44. Ring 46 is normally about 0.25" thick and about 0.395" to 0.40" wide. The ring may be made of any suitable synthetic material, however, it is preferred that ring 46 be formed of a polyester co-polymer such as HYTREL or a polyurethane elastomer such as VULKOLLAN. Presently the polyester is molded onto hub 44 while the polyurethane is cast onto the hub.

The elastic material forming ring 46 must have a high load bearing capacity, good resistance to chunking or decomposition, low rolling resistance, good retention properties at elevated temperatures, and adequate adhesion and adequate flexibility.

Figure 4:
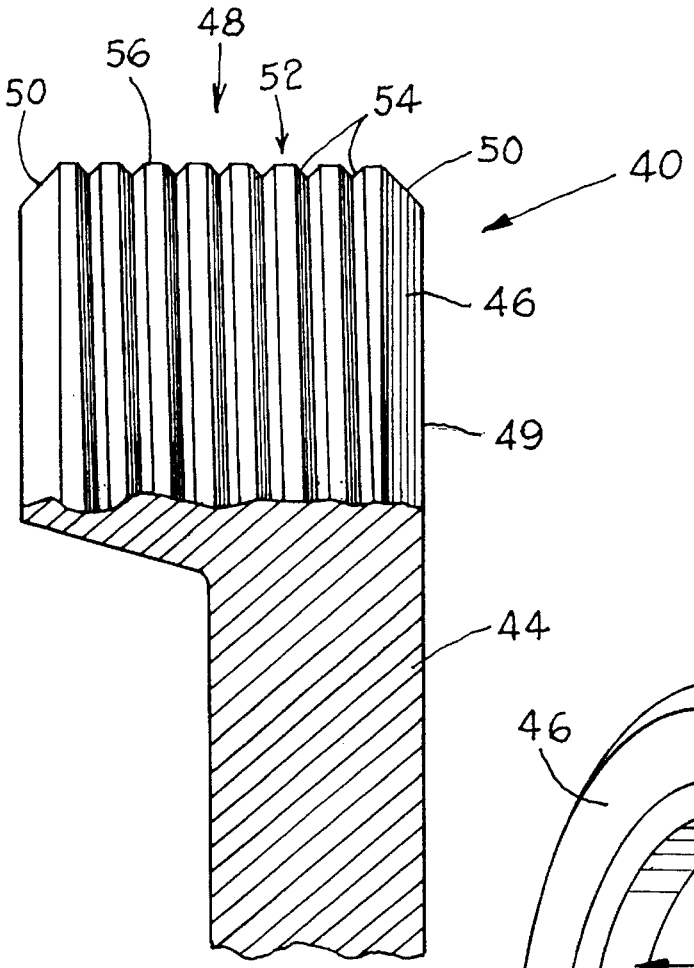
FIG. 4 is a sectional end view of FIG. 3 showing the helical arrangement of the rib forming spaced rotor contacting shoulders.
Figure 3:
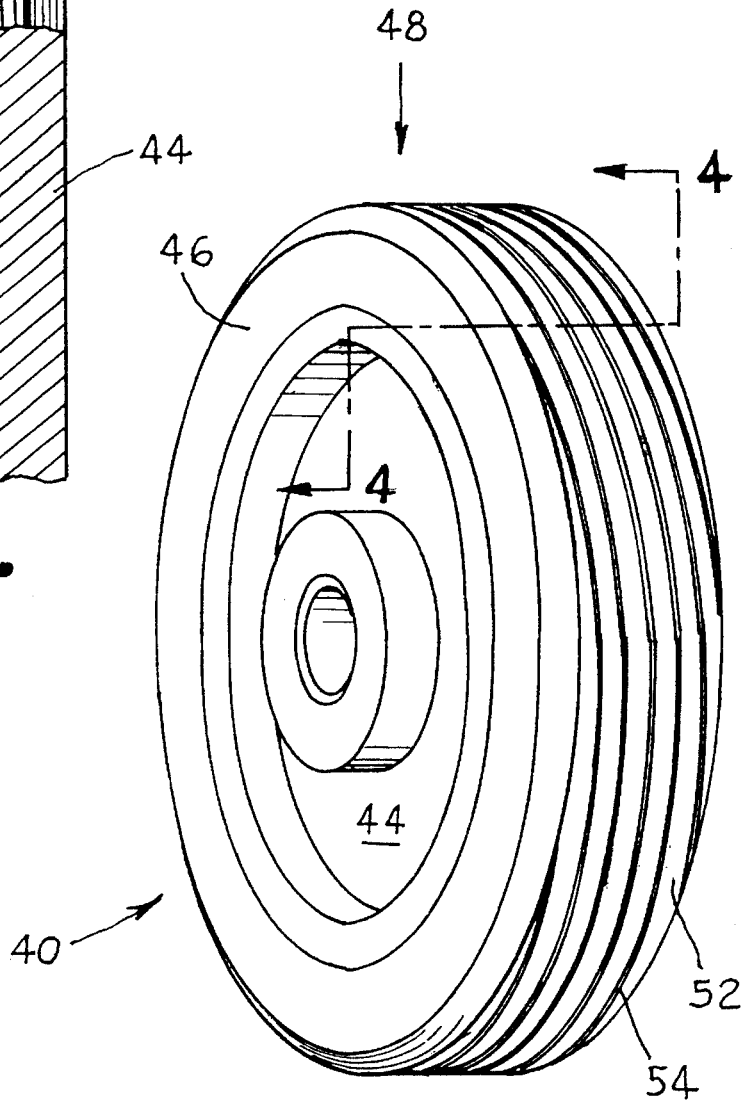
FIG. 3 is a perspective view of the supporting disk bearing having the spinning rotor shaft contacting surface comprised of a helically arranged ridge formed about the periphery of the disk.

Turning now to FIGS. 2B, 3, and 4, supporting disk 40 is shown in greater detail. FIG. 4 clearly shows hub 44 carrying elastic ring 46. Ring 46 includes opposed vertical side walls 49 which are joined by a substantially horizontal outer circumferential surface which forms a running surface 48. A chamfer 50 preferably but not necessarily is formed between walls 49 and running surface 50. A single rib 52 is helically formed over running surface 48 to appear between two and eight times across its width. Rib 52 is preferably begun at the right edge 49 adjacent chamfer 50 and spiraled or formed of convolutions in a continuous manner about the periphery of ring 46 until it terminates adjacent the left chamfer 50. Rib 52 comprises a pair of vertical side walls 54 which have a height of between 0.005" and 0.08" and an outer shoulder 56 which is between 0.02" and 0.04" in width. In practice, it is shoulder 56 which contacts the outer surface of rotor shaft 24.

FIGS. 3 and 4 show shoulders 56 and ridge 52 helically arranged in a counter clockwise direction as viewed from right to left.

In practice, supporting disk 40 are positioned in frame 10 with the helix formed by rib 52 being directed toward thrust bearing 18. It is noted that by providing a one way mount for bearing 32, as earlier described, the direction of the helix of rib 52 is always correct.

Rotor shaft 24 is positioned as shown in FIGS. 1, 2A, and 2B with shoulder 56 of rib 52 of each supporting disk 40 engaging with the outer surface of rotor shaft 24 in at least four positions. Drive 14 is pressed into engagement with the outer surface of shaft 24 with sufficient pressure to press the shaft against the multiple appearances of rib 52. Because of the limited width of the rib, this pressure causes rib 52 to compress slightly which increases the adhesion between shoulder 56 and the surface of rotor shaft 24. This increase in adhesion results in less slippage between the support disk 40 and rotor shaft 24 particularly during start up, but also during normal operation. This in turn reduces heat build up, reduces frictional wear, and increases the life of the supporting disk.

As disks 40 are rotably driven by rotor shaft 24, shoulders 56 of rib 52 axially urge rotor shaft 24 in the direction of the arrow which is toward thrust bearing 18. Due to the convolutions or helical configuration of rib 52 and the increased adhesion brought about by configuration of shoulder 56, rotor shaft 24 is prevented from axially oscillating but is maintained firmly against thrust bearing 18 by a constant force. By controlling the axial position of rotor 26 stationary, wear is reduced and more uniform spinning is achieved.

A further advantage of the ribbed running surface is that between eight and sixteen heat dissipating surfaces are created by rib walls 54. These allow for more complete and faster dispensation of any heat which may have built up in the elastic ring which prevents heat related degradation.

While a preferred embodiment of the invention has been described using specific terms, such description is for illustrative purposes only, and it is to be understood that changes and variations may be made without departing from the spirit or scope of the following claims.

What is claimed is:

1. A supporting disk bearing for use in an open end spinning machine having:

a frame;

a plurality of supporting disks arranged in pairs and mounted in said frame to form a wedge shaped gap;

a spinning rotor having an elongated rotor shaft, said rotor shaft being mounted in said gap in rotational engagement with said supporting disks;

a thrust bearing carried by said frame and arranged to engage an end of said rotationally mounted rotor shaft;

a drive carried by said frame and arranged transversely of said rotor shaft, said drive acting to press said rotor shaft against a running surface provided on each of said supporting disk;

said supporting disk comprising a hub carrying an elastic ring, the peripheral surface of said ring comprising said running surface;

said running surface including a helically formed rib convoluted toward said thrust bearing, said rib defining an outwardly directed shoulder having a plurality of turns which appear over said running surface, said shoulder adhering sufficiently with said rotor shaft to reduce slippage and to uniformly and continuously urge said rotor shaft against said thrust bearing during operation of said spinning machine, whereby;

said rotor shaft is constantly urged axially toward said thrust bearing to be maintained in smooth running engagement therewith.

2. The disk of claim 1 wherein said rib begins adjacent a first edge of said elastic ring, passes around said running surface a plurality of times and terminates adjacent a second edge of said ring.

3. The disk of claim 1 wherein said appearances of said shoulder of said rib are spaced by a continuous cavity, said cavity being formed at a depth of between 0.005" and 0.08" and a width of between 0.01" and 0.03".

4. The disk of claim 1 wherein said running surface has a width of between 0.3" and 0.31".

5. The disk of claim 1 wherein said shoulder appears across the width of said running surface between two and eight times.

6. The disk of claim 5 wherein said shoulder has a width of between 0.02" and 0.06".

7. The disk of claim 1 wherein said elastic ring is formed of polyurethane.

8. The disk of claim 1 wherein said elastic ring is formed of polyester copolymers.

9. The disk of claim 1 wherein said rib is continuous and uninterrupted along its entire length.

10. A method increasing the operational life of a supporting disk bearing in an open end spinning machine having:

a frame; a plurality of supporting disks arranged in pairs and mounted in said frame to form a wedge shaped gap; a spinning rotor having an elongated rotor shaft, said rotor shaft being mounted in said gap in rotational engagement with said supporting disks; a thrust bearing carried by said frame and arranged to engage an end of said rotationally mounted rotor shaft; a drive carried by said frame and arranged transversely of said rotor shaft, said drive acting to press said rotor shaft against a running surface provided on each of said supporting disk; the method including:

forming said supporting disk to include an elastic ring with its peripheral surface comprising said running surface;

forming a rib about said peripheral surface as a continuous helix convoluted toward said thrust bearing;

forming a rotor shaft contacting shoulder a top said helically arranged rib and forming said shoulder to include a plurality of turns which appear across said running surface, whereby;

during operation of said spinning machine said helically arranged rotor shaft contacting shoulder acts to prolong the life of said supporting disk by positively engaging said rotor shaft preventing slippage and by continuously urging said rotor shaft axially against said thrust bearing preventing axial motion of said rotor shaft.

11. The method of claim 10 including the method of providing a continuous channel along side said rib, said channel appearing a multiple of times across the width of said running surface providing an extended heat escape area.

12. The method of claim 10 including the method of providing at least four turns of said shoulder across said running surface.

13. The method of claim 12 including forming said shoulder to a width of at least 0.02".

14. The method of claim 10 including the method of forming said ring of a synthetic material comprising one of a polyurethane and a polyester.

15. A disk for use in a bearing assembly of an open end spinning machine having four disk arranged in two pairs and which operates at up to 15,000 RPM's, the disk pairs being arranged to form a wedge shaped gap supporting a shaft of a spinning rotor for rotation, wherein;

said disk comprises a hub having a synthetic ring;

said ring having a spinning rotor shaft contact surface comprising a shoulder arranged atop a helical rib, said rib extending around and across said contact surface, said rib imparting axial thrust against said spinning rotor shaft during operation of said spinning machine.

16. The disk of claims 15 wherein said shoulder includes a plurality of turns which appear across said contact surface.

17. The disk of claim 16 wherein said appearances of said shoulder of said rib are spaced by a continuous cavity, said cavity being formed at a depth of between 0.005" and 0.08" and a width of between 0.01" and 0.03".

18. The disk of claim 16 wherein said contact surface has a width of between 0.3" and 0.31".

19. The disk of claim 16 wherein said shoulder has a width of between 0.02" and 0.06".

20. The disk of claim 15 wherein said ring is formed of one of polyurethane polyester copolymers.

21. The disk of claim 15 wherein said shoulder is continuous and uninterrupted along its entire length.

* * * * *